United States Patent [19]

Rahnenführer et al.

[11] Patent Number: 5,052,304

[45] Date of Patent: Oct. 1, 1991

[54] PROPELLING CHARGE CONTAINER

[75] Inventors: Eckhard Rahnenführer, Dormagen; Albert Schulze, Monchen-Gladbach; Manfred Schüssler, Düsseldorf, all of Fed. Rep. of Germany

[73] Assignee: Rheinmetall GmbH, Düsseldorf, Fed. Rep. of Germany

[21] Appl. No.: 551,475

[22] Filed: Jul. 12, 1990

[30] Foreign Application Priority Data

Jul. 28, 1989 [DE] Fed. Rep. of Germany ..... 3924986

[51] Int. Cl.[5] ..... F42B 5/02; F42B 5/18; F42B 5/295

[52] U.S. Cl. ..... 102/435; 102/431; 102/700

[58] Field of Search ..... 102/435, 431, 432, 433, 102/282, 290, 700

[56] References Cited

U.S. PATENT DOCUMENTS

| | | | |
|---|---|---|---|
| 3,148,620 | 9/1964 | Jacobson et al. | 102/435 |
| 3,204,558 | 9/1965 | Jacobson et al. | 102/435 |
| 3,282,215 | 11/1966 | Roth | 102/435 |
| 3,397,636 | 8/1968 | Jacobson et al. | 102/435 |
| 3,426,684 | 2/1969 | Jacobson et al. | 102/435 |
| 3,727,512 | 4/1973 | Berger | 102/431 |
| 4,010,690 | 3/1977 | Cocozella et al. | 102/431 |
| 4,452,653 | 6/1984 | Lübben et al. | 102/431 |
| 4,712,481 | 12/1987 | Heinrich et al. | 102/435 |
| 4,911,078 | 3/1990 | Schulze et al. | 102/431 |

*Primary Examiner*—David H. Brown
*Attorney, Agent, or Firm*—Spencer & Frank

[57] ABSTRACT

A receptacle for the propelling charge for large caliber gun ammunition is combustible, and includes a barrel-protection coating which is applied directly to the interior surface of the receptacle. The coating is composed of a mixture of wax and titanium dioxide. In order to prevent the propelling charge powder in the receptacle from directly contacting the coating, the coating is covered with a thin metal foil, such as a thin lead foil.

10 Claims, 2 Drawing Sheets

FIG. 2
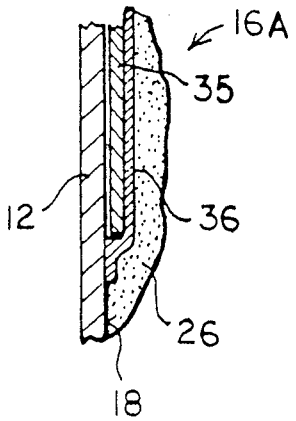
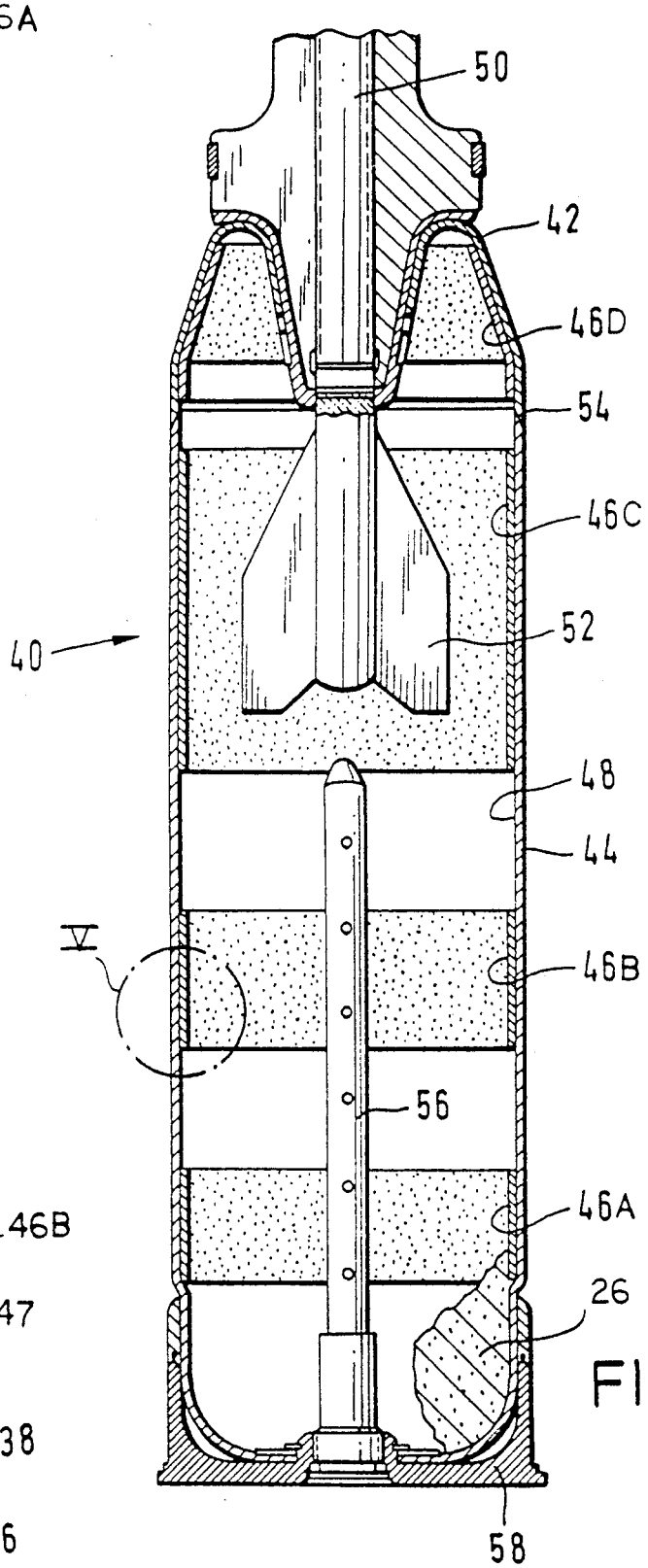
FIG. 4
FIG. 5
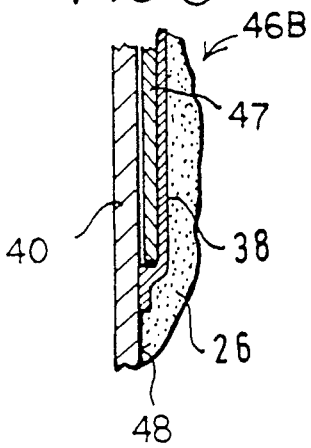

PROPELLING CHARGE CONTAINER

BACKGROUND OF THE INVENTION

The present invention relates to a propelling charge container and to a combustible propelling charge cartridge for large-caliber gun ammunition, particularly a completely combustible propelling charge module for artillery weapons.

U.S. Pat. No. 4,712,481 discloses a conventional metal cartridge with a glued-in additive cuff composed of a coated linen fabric, a polyethylene sheet, and rayon. The linen fabric is coated with a mixture of wax and titanium dioxide ($TiO_2$) and, as projection against abrasion, is covered toward the interior with the plastic sheet and the further textile layer. This special configuration of the multi-layer additive cuff is intended to prevent retardation of the powder due to the abrasion of wax under mechanical stress at high temperatures. The propelling charge particles are thus able to slide along the rayon without damaging the cuff. The drawback of this prior art additive cuff is that problems arise from reactions during detonation because the additive cuff, which is composed of several layers, may leave unacceptable residues in the gun barrel.

The mixture of wax and titanium dioxide applied to the additive cuff acts on the interior of the non-combustible metal casing, and a special effect on the gun barrel is hardly to be expected. Combustion residues occur, in particular, because the exterior of the cuff does not reach sufficiently high ignition temperatures since the heat is absorbed and dissipated by the metal casing, which provides a cooling effect.

SUMMARY OF THE INVENTION

It is an object of the present invention to provide a combustible propelling charge container, that is, a combustible propelling charge casing, whose reaction in the gun barrel during detonation completely avoids combustion residues, with the tube-protecting and erosion-reducing effect being increased, particularly in large-caliber artillery weapons and particularly if modular propelling charges are employed. In the latter case, no greater erosion should occur, in spite of the greater weight of the charge, than in prior art charge systems.

This is accomplished by the present invention in that a coating, that is, a mixture of wax and titanium dioxide ($TiO_2$), is applied directly to the interior of the combustible casing material by spackling, painting, spraying or the like, without additional carrier materials. In this way, the tube-protecting and erosion-reducing effect of the combustible casing material is augmented even further.

Advisably, the coating of wax and $TiO_2$ is covered with a thin metal foil on the side toward the powder. The metal foil has a thickness of less than 0.5 mm, preferably about 0.05 mm. The foil is preferably composed of a metal or metal alloy from the group of elements including lead, zinc, tin, aluminum, magnesium, iron, nickel, silver, molybdenum or a corresponding suitable metal. The foil prevents retardation, that is, passivation, of the contacting propelling charge grains by the coating. It also prevents or at least reduces undesirable copper deposits on the tube (for example, from the guide bands of the projectiles).

BRIEF DESCRIPTION OF THE DRAWINGS

FIG. 2 is an enlarged sectional view of detail II in FIG. 1.

FIG. 4 is a sectional view showing an ammunition round having a partially combustible propelling charge casing according to a further embodiment of the invention.

FIG. 5 is an enlarged sectional view of detail V in FIG. 4.

DESCRIPTION OF THE PREFERRED EMBODIMENTS

Figure 1:
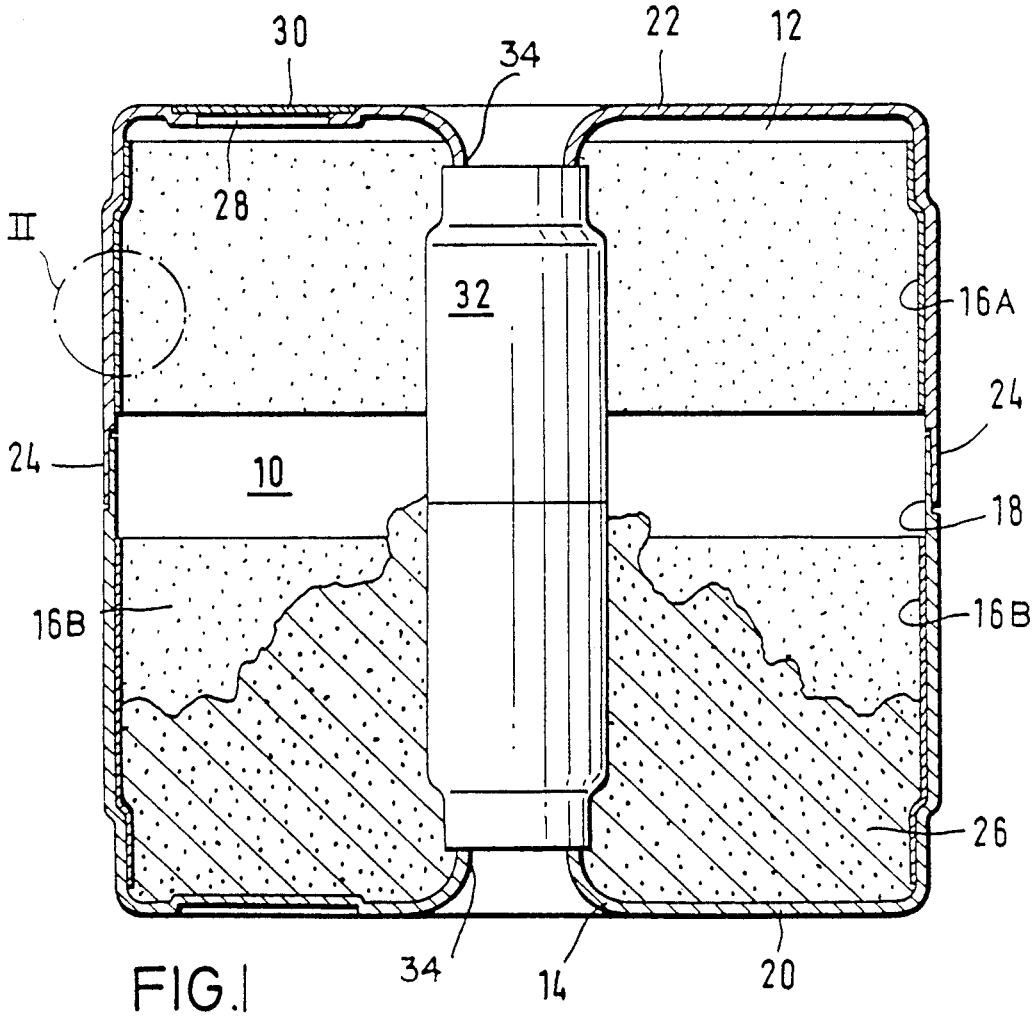
FIG. 1 is a sectional view showing a propelling charge module having a complete propelling charge container according to an embodiment of the invention.

FIG. 1 illustrates a modular propelling charge module for a 155-mm artillery weapon, the module including a receptacle in the form of a propelling charge container 10 in accordance with an embodiment of the invention. Propelling charge container 10 is composed of an upper shell 12 and a lower shell 14. Shells 12 and 14 may be made, for example, of pressed and shaped nitrocellulose paper. The cylindrical interior surface 18 of upper shell 12 and of lower shell 14 is provided in each case with a barrel protection band, identified as protection bands 16A and 16B, which will be discussed in more detail later. At a central junction region 24, upper shell 12 and lower shell 14 are glued to one another. The bottom 20 of lower shell 14 and the top 22 of upper shell 12 each have an inwardly oriented annular flange 34 for fixing a tubular piece 32 which is configured as a central ignition element.

Propelling charge container 10 is filled with a powdered or granular propelling charge agent 26. For filling propelling charge agent 26 into the finished propelling charge container 10, the top 22 of upper shell 12 is provided, for example, with an off-center fill opening 28 which, once propelling charge agent 26 has been filled in, is sealed against environmental influences in a gas-tight manner by a glued-on sealing cover 30.

FIG. 2 illustrates a barrel protection band, for example band 16A, in more detail. It includes a coating 35 of wax and titanium dioxide ($TiO_2$). The wax serves as a sliding agent during ignition of the propelling charge module, upon relative movement of the burning propelling charge container wall and the individual powder grains. The titanium dioxide lowers the peak combustion temperatures of the propelling charge powder in the region of the barrel or tube wall. Thus the components of the coating 35 have an erosion-reducing effect and extend the useful service life of the weapon. The wax may be U.S. Standard MIL-W-13945, for example type v, and the $TiO_2$ may be U.S. Standard MIL-T-48149. Coating 35 preferably contains 30–60% wax and 35–65% $TiO_2$, with perhaps 5% being other substances. The thickness of coating 35 preferably lies in the range 0.5mm to 5mm.

In order to prevent direct contact of propelling charge powder grains with coating 35 (which might cause abrasion of the coating 35 and passivation of the powder grains), band 16A also includes a glued-on or pressed-on thin metal foil 36 which covers coating 35. Metal foil 36 has a thickness of less than 0.5 mm, preferably about 0.05mm. Metal foil 36 also prevents undesirable copper deposits on the gun barrel (not illustrated); such copper deposits might otherwise form from the guide bands of the projectiles (not illustrated). The metal foil 36 is preferably made of lead, but some other metal alloy, for example an aluminum alloy containing magnesium or other light metals, could be used instead.

Figure 3:
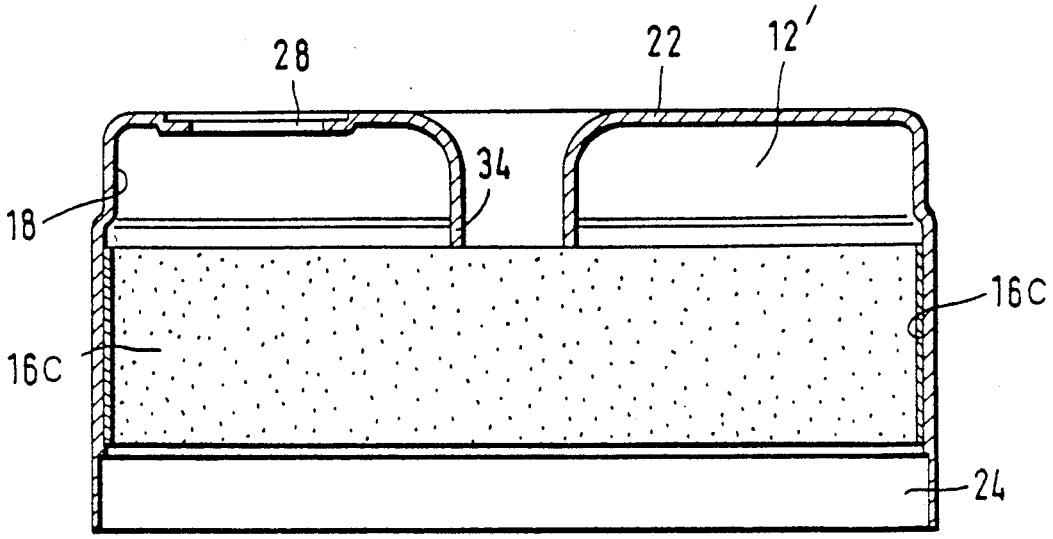
FIG. 3 is a sectional view through the upper shell of a slightly modified embodiment of a propelling charge container according to the invention.

The coating of wax and titanium dioxide and the metal foil may cover the entire inner surface 18, instead of only zones or regions thereof as shown in FIG. 1. Furthermore, FIG. 3 illustrates an upper shell 12' having a reduced-width protection band 16C.

FIG. 4 shows an ammunition round which includes a receptacle in the form of a combustible propelling charge casing 40 in accordance with the present invention, and a sub-caliber kinetic energy projectile 50 which is equipped with a guide mechanism 52. Propelling charge casing 40 includes a cylindrical casing member 44 and a conical cover 42 at the top to support the projectile 50, that is, the propelling cage. Casing member 44 and cover 42 are combustible, and may be made of pressed and shaped nitrocellulose paper. Casing 40 also includes a non-combustible stub casing 58, for example of metal or plastic, which holds a primer 56 (ignition tube). In the junction region 54, the conical cover 42 is glued to the casing member 44.

The cylindrical interior surface 48 of propelling charge casing 40 is covered with barrel protection bands 46A, 46B, and 46C. Similarly, a barrel protection band 46D is mounted on the interior surface of conical cover 42. The barrel protection bands may cover the entire interior surface 48 of propelling charge casing 40 or, as shown in FIG. 4, only zones or regions thereof. Propelling charge casing 40 is completely filled with propelling charge powder 26. As is shown in FIG. 5, barrel protection band 46B, for example, includes a coating 47 of wax and titanium dioxide ($TiO_2$). In order to prevent direct contact of propelling charge powder grains with coating 47 (which might cause abrasion of the coating 47 and passivation of the powder grains), coating 47 is covered toward the interior with a glued-on or pressed-on thin metal foil 38. As was the case with band 16A, discussed previously in conjunction with FIG. 2, the wax serves as sliding agent during ignition of the propelling charge casing 40, upon relative movement of the burning propelling charge casing wall and the individual powder grains, and the titanium dioxide lowers the peak combustion temperatures of the propelling charge powder in the region of the barrel or tube wall. Furthermore the metal foil 38 prevents undesirable copper deposits on the gun barrel which might otherwise form from the guide bands of the projectiles (not illustrated). The metal foil has a thickness of less than 0.5 mm, preferably about 0.05 mm, and is preferably made of lead (although a metal alloy, for example of an aluminum alloy containing magnesium or other light metals, could be used instead).

As a whole, the present invention thus realizes a noticeable protection and prolongation of the service life of the gun barrel.

It will be understood that the above description of the present invention is susceptible to various modifications, changes, and adaptations, and the same are intended to be comprehended within the meaning and range of equivalents of the appended claims.

What we claim is:

1. A propelling charge receptacle for use with large-caliber gun ammunition, comprising:

a combustible receptacle which includes a propelling charge container having an upper shell with a shell top and with a generally cylindrical wall portion and having a lower shell with a shell bottom and with a generally cylindrical wall portion, the wall portions of the upper and lower shells being connected at a junction region, the wall portions having interior surfaces; and a coating of wax and titanium dioxide which is directly applied to the interior surfaces of the wall portions of the upper and lower shells.

2. A propelling charge receptable for use with large-caliber gun ammunition, comprising:

a combustible receptacle which includes a propelling charge casing having a combustible cover with a conical interior surface and having a cylindrical casing with an interior surface;

a coating of wax and titanium dioxide which is applied directly to the conical interior surface of the cover and to at least individual regions of the interior surface of the cylindrical casing; and a non-combustible stub casing for armor piercing ammunition, the stub casing being connected to the cylindrical casing.

3. A propelling charge receptacle for use with large-caliber gun ammunition, comprising:

a combustible receptacle which is to be filled with propelling charge agent, the receptacle having an interior surface;

a coating of wax and titanium dioxide directly applied to the interior surface of the receptacle; and a thin metal foil covering the coating of wax and titanium dioxide.

4. The propelling charge receptacle of claim 3, wherein the metal foil is made of a metal selected from the group consisting of lead, zinc, tin, aluminum, magnesium, and a metal alloy of at least one of the foregoing metals.

5. The propelling charge receptacle of claim 3, wherein the interior surface of the receptacle to which the coating is applied is generally cylindrical.

6. The propelling charge receptacle of claim 3, wherein the metal foil has a thickness of less than about 0.5 mm.

7. The propelling charge receptacle of claim 6, wherein the metal foil has a thickness of about 0.05 mm.

8. A method for making a propelling charge container which includes a combustible upper shell with a shell top and a generally cylindrical wall portion, and a combustible lower shell with a shell bottom and a generally cylindrical wall portion, the wall portions of the upper and lower shells having interior surfaces, said method comprising the steps of:

(a) applying a coating of wax and titanium dioxide to the interior surface of the wall portion of the upper shell and to the interior surface of the wall portion of the lower shell;

(b) covering the coatings on the interior surfaces of the wall portions with thin metal foil;

(c) fastening the wall portions of the upper and lower shells at a junction region;

(d) introducing a propelling charge agent into the shells through a fill opening; and (e) closing the fill opening with a sealing cover.

9. The method of claim 8, wherein the fill opening is provided in the shell top, and wherein step (c) is accomplished by gluing the wall portions together at the junction region.

10. The method of claim 8, wherein the step (a) is accomplished by one of spackling, painting, and spraying without additional carrier materials.

* * * * *